US006907216B2

(12) United States Patent
Nishimura

(10) Patent No.: US 6,907,216 B2
(45) Date of Patent: Jun. 14, 2005

(54) IMAGE FORMING APPARATUS HAVING A ROLL SUPPORTING MEMBER

(75) Inventor: Toshinori Nishimura, Mie (JP)

(73) Assignee: Kyocera Corporation (JP)

( * ) Notice: Subject to any disclaimer, the term of this patent is extended or adjusted under 35 U.S.C. 154(b) by 23 days.

(21) Appl. No.: 10/310,111

(22) Filed: Dec. 4, 2002

(65) Prior Publication Data

US 2003/0156862 A1 Aug. 21, 2003

(30) Foreign Application Priority Data

Dec. 4, 2001 (JP) ..... 2001-369472
May 20, 2002 (JP) ..... 2002-144809

(51) Int. Cl.[7] ..... G03G 15/08
(52) U.S. Cl. ..... 399/282
(58) Field of Search ..... 399/119, 252, 399/265, 272, 279, 281, 282

(56) References Cited

U.S. PATENT DOCUMENTS 4,563,074 A * 1/1986 Tsutsui et al. ..... 399/119
4,827,305 A * 5/1989 Enoguchi et al. ..... 399/119
5,848,330 A * 12/1998 Nakaue et al. ..... 399/119
6,316,534 B1 * 11/2001 Shimokusuzono et al. .. 524/284
6,654,583 B2 * 11/2003 Suzuki et al. ..... 399/281

FOREIGN PATENT DOCUMENTS

JP 62251773 A * 11/1987 ..... G03G/15/08
JP 6067546 3/1994
JP 7092804 4/1995
JP 10149011 A * 6/1998 ..... G03G/15/08
JP 11272049 A * 10/1999 ..... G03G/15/08
JP 2000275967 10/2000
JP 2001013848 1/2001

* cited by examiner

*Primary Examiner*—Robert Beatty
(74) *Attorney, Agent, or Firm*—Schulte Roth & Zabel, LLP; Joel E. Lutzker; John C. Garces

(57) ABSTRACT

In order to provide an image forming apparatus capable of forming a quality image by restricting a distance between a developing roll and a magnetic roll with a simple structure, an image forming apparatus comprises a magnetic roll 1 and a developing roll 2 that are disposed in parallel with a predetermined distance and a developing unit 50 that develops an electrostatic latent image on a photosensitive body drum 3 disposed on the image forming apparatus main body using a toner thin layer formed on the surface of the developing roll by the magnetic roll, wherein a member for holding rotational axes having a pair of openings for holding, which fits and holds rotatably and integrally each of rotational axes of the magnetic roll and the developing roll is provided, the opening for holding of the developing roll being capable of swinging around the axis center of the opening for holding of the magnetic roll.

3 Claims, 10 Drawing Sheets

IMAGE FORMING APPARATUS HAVING A ROLL SUPPORTING MEMBER

BACKGROUND OF THE INVENTION

1. Field of the Invention

The present invention relates to an image forming apparatus by an electro-photography process such as a copying machine, a printer, a facsimile machine or a combined machine of these, the apparatus having a means for restricting a distance between a photosensitive body drum and developing roll or a distance between a developing roll and a magnetic roll and more particularly to a developing unit used in an image forming apparatus such as a copying machine, a printer, a facsimile machine or a combined machine of these. Further the present invention relates more particularly to an image forming apparatus having a developing unit that develops an electrostatic latent image by placing only charged toner on a developing roll from a two component developer material, in which a non-magnetic toner is charged by means of a magnetic carrier, and by causing the toner to jump to the electrostatic latent image.

2. Description of the Related Art

Heretofore, a non-contact system image forming apparatus that develops an electrostatic latent image by placing only charged toner on a developing roll from a two component developer material, in which a non-magnetic toner is charged by means of a magnetic carrier, and by causing the toner to jump to the electrostatic latent image has been publicly known by Japanese laid-open patent publication, JP1994-67546, JP1995-92804 or others. In these prior arts, since an apparatus has a photosensitive body drum, a developing roll and a magnetic roll, the gap between the photosensitive body drum and the developing roll or between the developing roll and the magnetic roll being large so as to affect the image, a structure giving consistently stable distance for the both gaps are required. Meanwhile, Japanese laid-open patent publication, JP2000-275967 (prior art 1) discloses the art in which a spacer roller having a larger diameter than the developing roll is provided coaxially with the developing roll to restrict the distance between the photosensitive body drum and the developing roll.

Further, Japanese laid-open patent publication, JP2001-13848 (prior art 2) discloses the following art that prevent dappled images by reducing and uniformizing a contact pressure between a developing roll and a photosensitive roll. A developing unit is fixed to a photosensitive body unit so as to be capable of swinging and a point of action for communicating rotational force to the developing unit is disposed in the vicinity of swinging center axis of the photosensitive body and the developing unit whereby since when rotational force affects the developing unit, the developing unit swings with respect to the photosensitive body unit, the developing roll can contact the photosensitive roll at the constantly stable state without causing the developing roll to be pressed to the photosensitive body.

In the prior art 1, since the photosensitive roll, the developing roll and a supporting member for the spacer roller are supported in a same developing frame, even though the spacer roller touches the surface of the photosensitive body drum, a weight of the supporting member of those things including the developing roll and the spacer roller does not affect the photosensitive roll. However, in case a structure is constituted as a separate developing unit including a developing roll, a spacer roller, a magnetic roll, a toner container and others, which is attachable to and detachable from the image forming apparatus body, for replenishing toner by pulling out the developing unit, since a weight of the developing unit affects the photosensitive body drum, reduction of durability of the photosensitive body drum is apprehended.

Further, an appropriate gap not only between the developing roll and the photosensitive body drum but also between the developing roll and a magnetic roll is necessary to be kept. Variation of the distance between them causes variation of the layer thickness of magnetic brush on the magnetic roll, which further causes variation of the layer thickness of toner on the developing roll. As these result in unsatisfactory image formation, a complicated structure to ensure toner supply to the developing roll by increasing the rotational rate of the developing roll is necessary.

In the prior art 2, though the art in which a developing roll touches a photosensitive body in a constantly stable state by the means that a developing unit is fixed to a photosensitive body unit so as to be capable of swinging is disclosed, the art is merely for stabilizing the touch between the developing roll and the photosensitive body drum. In JP1994-67546, JP1995-92804 or others, the problem is it is difficult to keep a stable distance between the photosensitive body drum and the developing roll or between the developing roll and the magnetic roll in a developing unit using two components developer material.

SUMMARY OF THE INVENTION

The present invention was performed to solve the above-mentioned problems and an object of the present invention is to provide an image forming apparatus that forms quality images by restricting the distance between a developing roll and a magnetic roll with a simple structure.

Another object of the present invention is to provide an image forming apparatus in which even if a photosensitive body drum is disposed on a image forming apparatus body itself and a developing roll is disposed on a unit attachable to and detachable from the image forming apparatus body itself, a weight of the unit does not affect the photosensitive body drum.

Yet another object of the invention is to provide an image forming apparatus having low-friction-material members at bearings of rotating parts such as a magnetic roll, developing roll and others to avoid vacancies generated due to abrasion so as to enhance the distance-restriction-accuracy between the rolls.

To solve the above problems and according to the present invention, an image forming apparatus comprises a magnetic roll and a developing roll that are disposed in parallel with a predetermined distance and a developing unit that develops an electrostatic latent image on a photosensitive body drum disposed on the image forming apparatus main body using a toner thin layer formed on the surface of the developing roll by means of the magnetic roll, wherein a member for holding rotational axes having a pair of openings for holding, which fits and holds rotatably and integrally each of rotational axes of the magnetic roll and the developing roll is provided, the opening for holding of the developing roll being capable of swinging around the axis center of the opening for holding of the magnetic roll.

According to the invention, since the accuracy of a pitch between the opening for holding of the developing roll and the opening for holding of the magnetic roll is high, the opening for holding of the developing roll can swing around the axis center of the opening for holding of the magnetic roll without varying the pitch so that the distance between the developing roll and the magnetic roll can be constructed with accuracy.

As an effective measures according to the present invention, a fitting part of the magnetic roll or the developing roll to the opening for holding on the member for holding rotational axes consists of low friction material whereby the fitting part abrades little enhancing durability.

As another effective measures according to the present invention, an annular member for restricting a distance between the developing roll and the photosensitive body drum by contacting the photosensitive body drum is rotatably fitted coaxially with the axis of the developing roll while a pressing device is provided to press the annular member for restricting the distance, the member for restricting the distance being constituted so as to contact a cylindrical plane of the drum on or below the line generated by intersecting the cylindrical plane with a horizontal plane including the axis of the photosensitive body drum.

Thus, natural force of the weight of the developing unit does not affect the photosensitive body drum and the weight of a member that holds the developing roll and the magnetic roll does not affect the surface of the photosensitive body drum through the member for restricting the distance even though the member is pressed to the drum when the member touches the drum since the annular member for restricting the distance between the developing roll and the photosensitive body drum by contacting the photosensitive body drum is constituted so as to contact a cylindrical plane of the drum on or below the line generated by intersecting the cylindrical plane with a horizontal plane including the axis of the photosensitive body drum.

As yet another effective measures according to the present invention, a developing unit is provided attachably to and detachably from the image forming apparatus main body wherein a positioning member is provided on the image forming apparatus main body, which fits the member for holding rotational axes for positioning when the developing unit is finished to be mounted.

It is necessary to holds the developing roll, which is horizontally apart from the photosensitive body drum, by pressing to the surface of the drum as a whole developing unit at the state of contacting the member for restricting the distance. The pressure is absorbed by the positioning member where only the pressure of the pressing means affects the surface of the photosensitive body drum. Thus, durability is enhanced by reducing the pressure to the photosensitive body drum.

According to the present invention, an image forming apparatus further comprises a gear for the magnetic roll provided to the magnetic roll, an idle gear, a gear for the developing roll which is provided to the developing roll and receives a driving force from the gear for the magnetic roll through the idle gear and a member for holding rotational axes which swings around the axis of the magnetic roll and hold rotatably each rotational axis of the magnetic roll, the developing roll and the idle gear.

Thus, the predetermined distance between the magnetic roll and the developing roll is accurately maintained since each axis of the magnetic roll and the developing roll is rotatably held by the member for holding rotational axes which swings around the axis of the magnetic roll. In addition, as the idle gear is rotatably held by the member for holding rotational axes, the distance between axes of the gear for magnetic roll and the idle gear is all the time constant and further the distance between axes of the gear for developing roll and the idle gear is constant at any given time.

DETAILED DESCRIPTION OF THE PREFERRED EMBODIMENT

The invention will now be described below in detail by way of example with reference to the accompanying drawings. It should be understood, however, that the description herein of specific embodiments such as to the dimensions, the kinds of material, the configurations and the relative disposals of the elemental parts and the like is not intended to limit the invention to the particular forms disclosed but the intention is to disclose for the sake of example unless otherwise specifically described.

Figure 10:
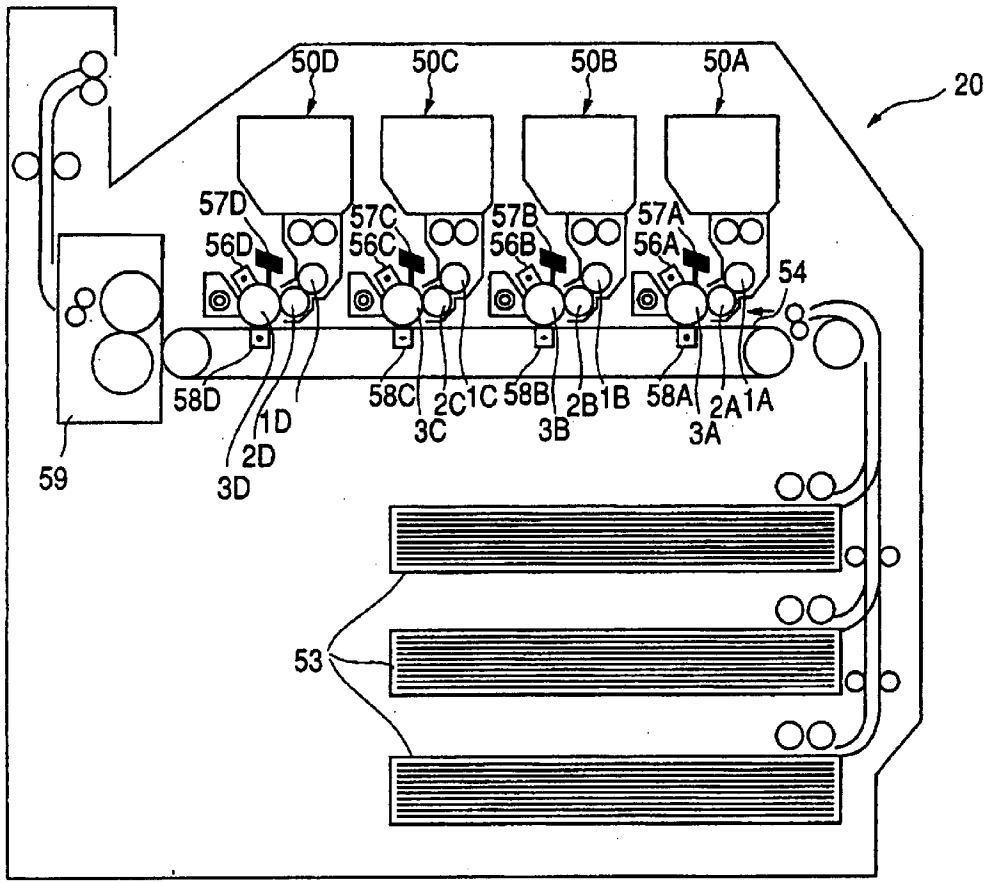
FIG. 10 is a schematic drawing showing a constitution of a color image forming apparatus in which an image forming apparatus according to an embodiment of the present invention.

First, referring to FIG. 10, an endless belt 54 is disposed at an image forming apparatus so as to be capable of transporting recording paper toward a fixing device 59 from a paper-supplying cassette 53. A developing unit for black 50A, a developing unit for yellow 50B and a developing unit for cyan 50C and a developing unit for magenta 50D are disposed over the belt 54 which transports recording paper.

In the developing units 50(A, B, C, D), magnetic rolls 1 (A, B, C, D) are disposed, developing rolls 2(A, B, C, D) are disposed adjacent to the magnetic rolls 1 (A, B, C, D), photosensitive body drums 3(A, B, C, D) are disposed facing to the developing rolls and charging devices 56(A, B, C, D) and exposing devices 57(A, B, C, D) are disposed.

When a signal for beginning to print is communicated from a control circuit (not shown), carrier and toner are stirred so that the toner is electrically charged by friction to adhere to the surface of the carrier. Magnetic brushes are formed on the surface of the magnetic rolls 1(A, B, C, D) by means of carrier and toner thin layers are formed on the developing rolls 2(A, B, C, D).

The belt 54 transports recording paper from the paper-supplying cassette 53. In order to synchronize with the times when the recording paper reaches each of the photosensitive body drums 3 (A, B, C, D), the charging devices 56 (A, B, C, D) charge the photosensitive body drums 3, the exposing devices 57 (A, B, C, D) expose images to the photosensitive body drums 3 by an image signals to form electrostatic latent images and toner on the developing rolls 2 develops the latent images. When the recording paper reaches the photosensitive body drums 3, the transfer devices 58 (A, B, C, D) apply transfer bias potential to the recording paper to transfer toner images and the fixing device 59 fixes the toner images.

Figure 7:
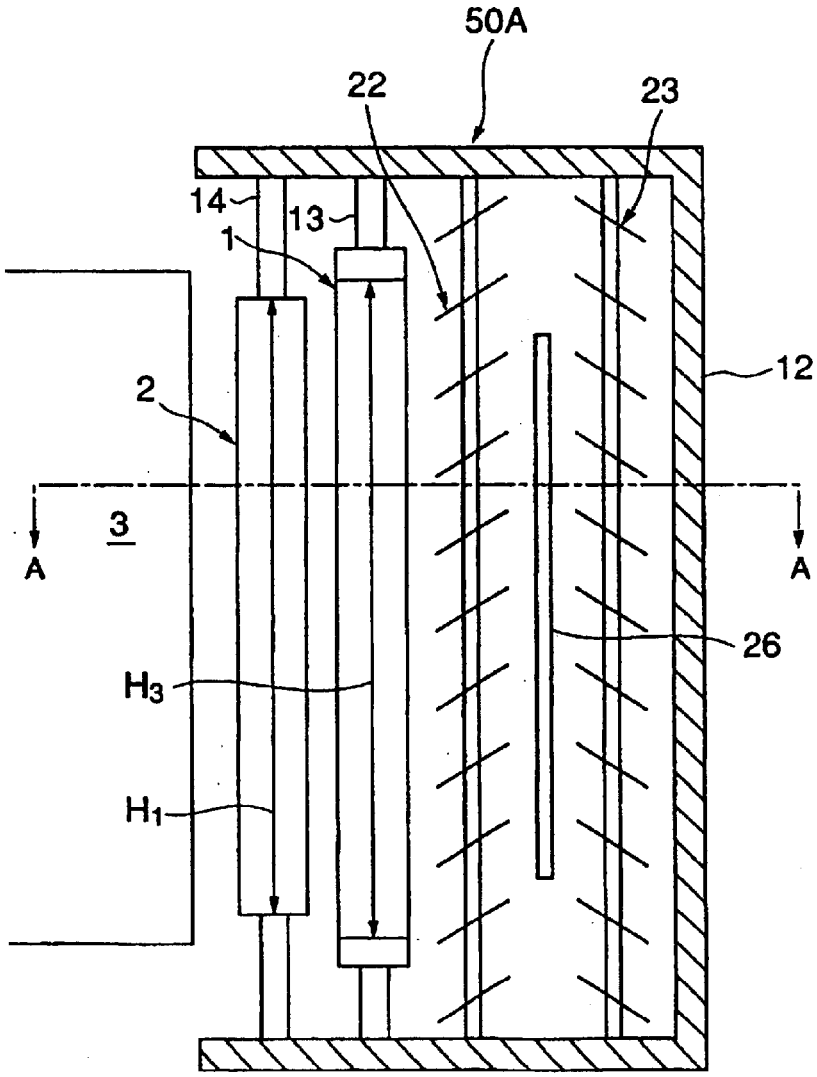
FIG. 7 is a schematic drawing illustrating a relationship between a photosensitive body and a developing device according to an embodiment of the present invention.

Since an action of each unit is the same though FIG. 10 shows four units in developing units 50, the developing unit 50A is typically explained below for the all. Referring to FIG. 7, in a frame 12 having a u-shape sectional view, the developing roll 2 is disposed at a predetermined distance from the photosensitive body drum 3 and the magnetic roll 1 is disposed at a predetermined distance from the developing roll 2, the magnetic roll 1 being formed as a cylinder of non-magnetic metal and the magnetic roll 1 having a plurality of stationary magnets in the cylinder and a sleeve rotatably fitted around the cylinder. A width in the axis direction of the sleeve (a magnetic brush forming region) $H_3$ is formed longer than a width in the axis direction of the developing roll 2 $H_1$. Just for reference, 26 is a separator panel for separating between a stirring mixer 23 room and a paddle mixer 22 room.

Figure 1:
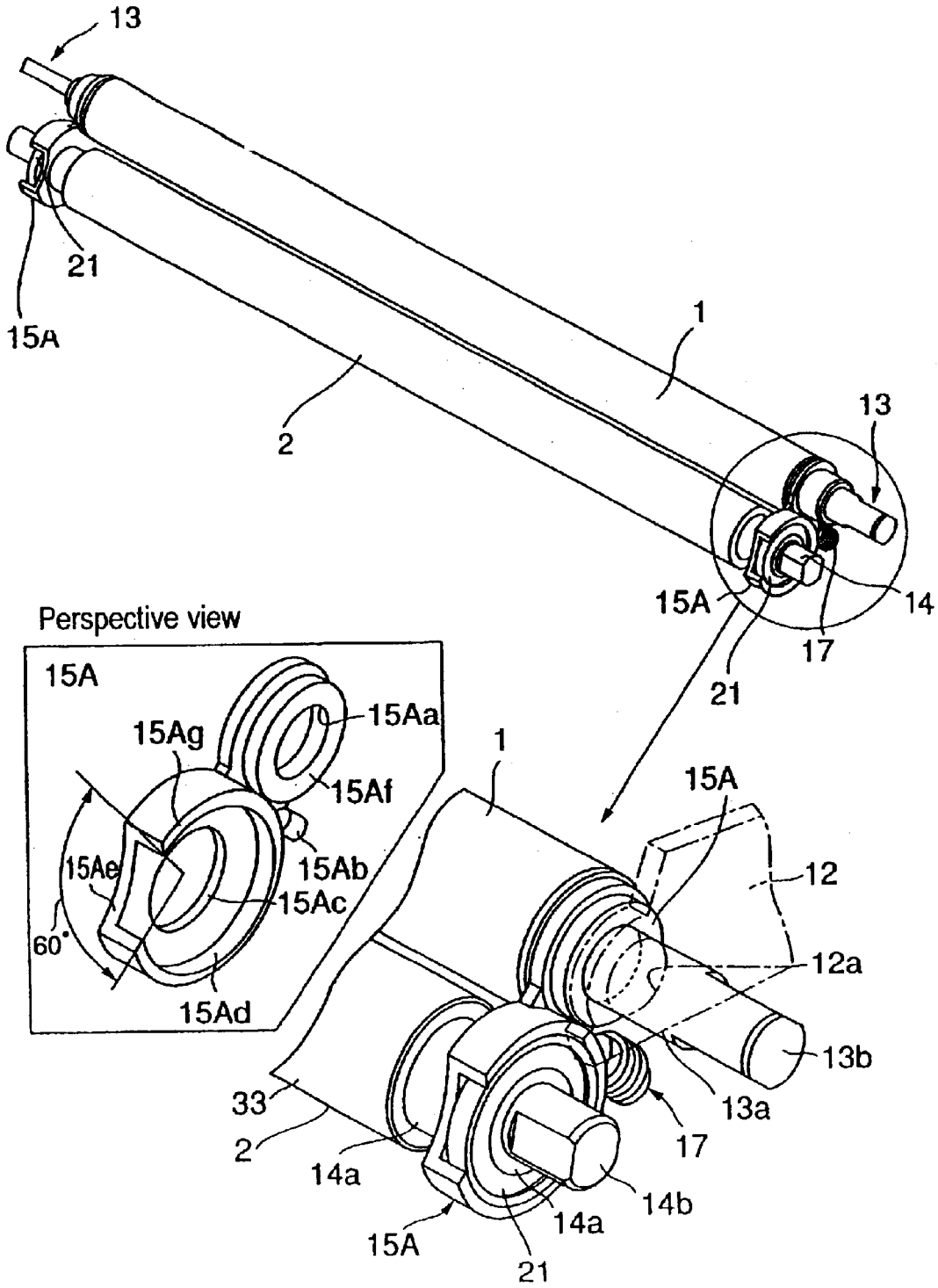
FIG. 1 is a perspective view showing an image forming apparatus in which a developing roll and a magnetic roll are built according to an embodiment of the present invention.
Figure 5:
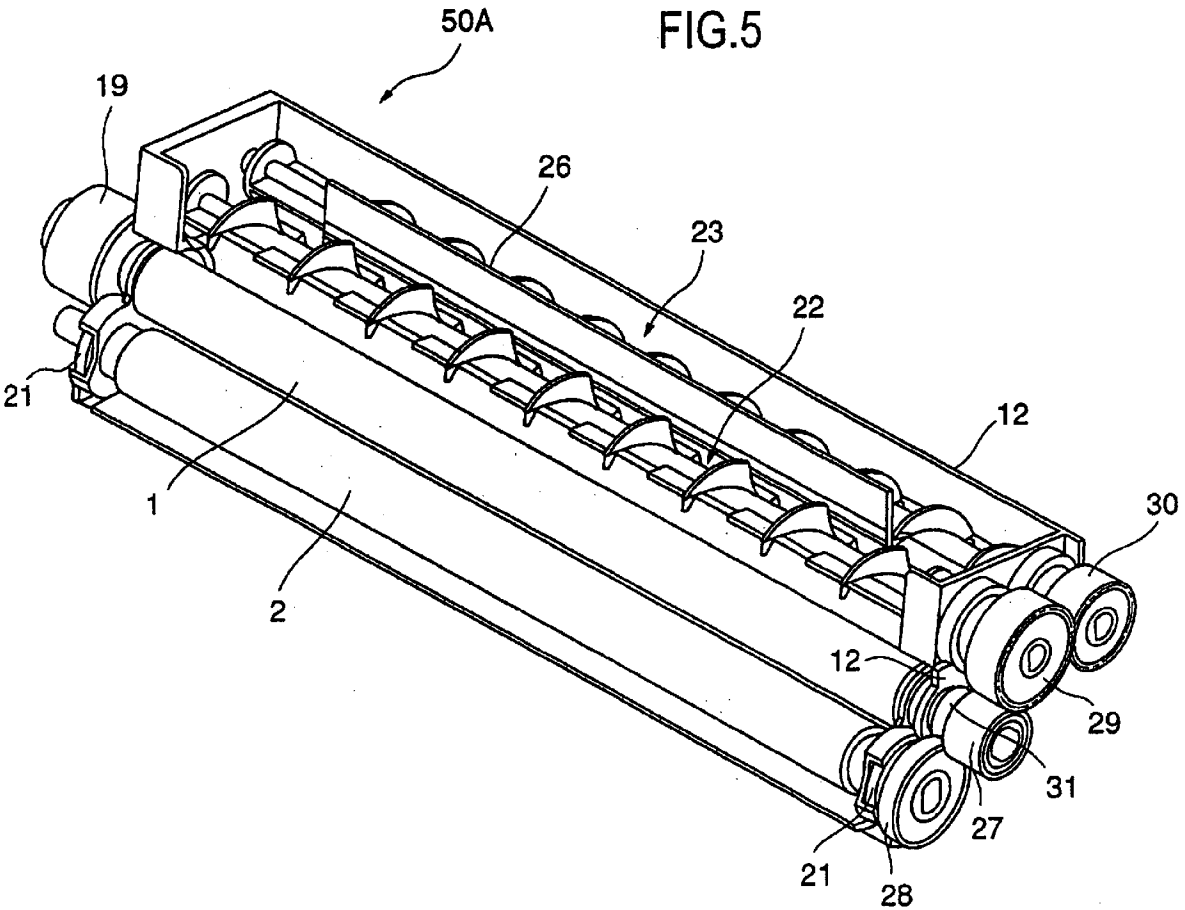
FIG. 5 is a perspective drawing showing the developing unit shown in FIG. 1.

As shown in FIG. 1 or FIG. 5, a motor 19 is fixed at one side of the frame 12 and the magnetic roll 1 has magnetic roll axes 13 at the both ends, one end of which is connected to a rotating axis of the motor 19 and the other end of which protrudes from the frame 12 through an opening 12*a*. A transmitting gear 27 and a transmitting gear 31 are fixed coaxially with the magnetic roll to the protruded end part 13*b* having two planes for fixing along axis.

A driving gear 28 which engages the transmitting gear 31 is fixed to the end 14*b* of the developing roll axis 14; a driving gear 29 which engages the transmitting gear 27 is fixed to the paddle mixer 22; and a driving gear which engages the driving gear 29 is fixed to the stirring mixer 23.

Figure 8:
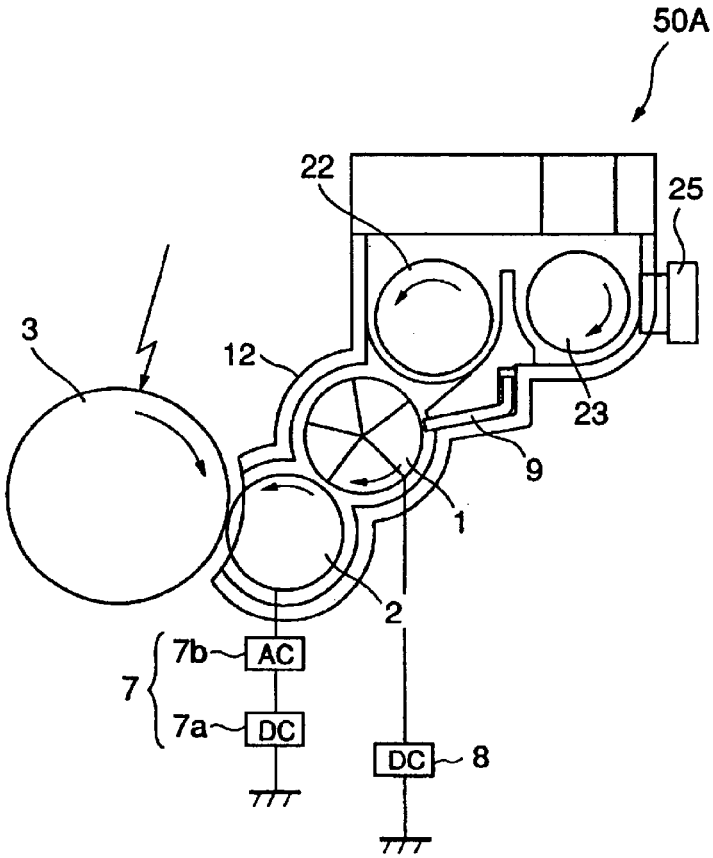
FIG. 8 is a sectional view of FIG. 7 cut by A—A plane.

As shown in FIG. 8, a DC bias potential 7*a* and an AC bias potential 7*b* is applied between the photosensitive body drum 3 and the developing roll 2; a DC bias potential 8 is applied to the magnetic roll 1; a restricting blade 9 restricts the thickness of the magnetic brush; and a toner sensor 25 detects toner.

Figure 2:
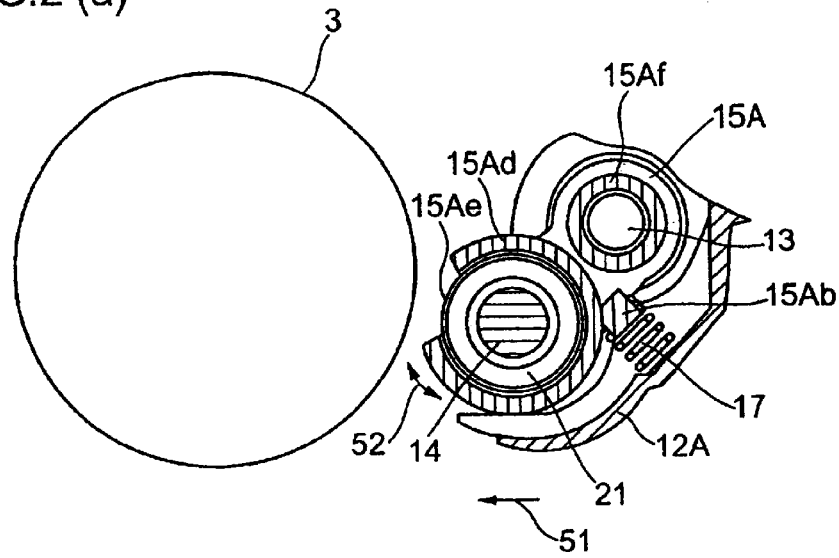
FIG. 2 is a schematic drawing illustrating a behavior of a developing unit in which a roll-supporting member of the developing roll and the magnetic roll is built.
Figure 2:
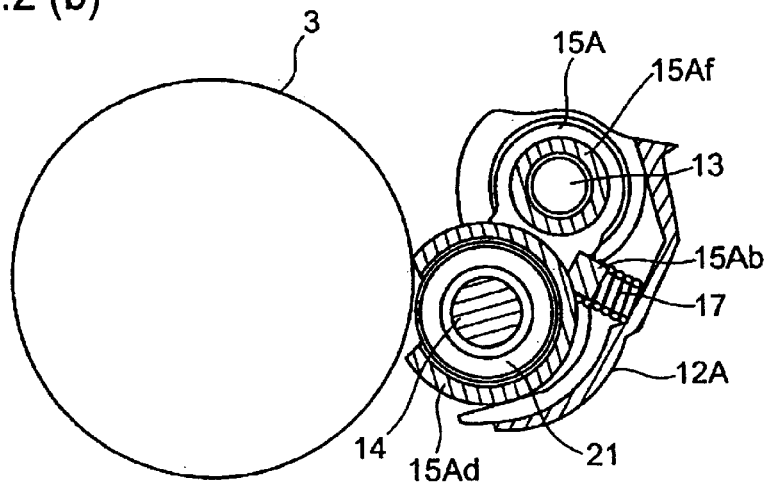

Referring FIG. 1 and FIG. 2, a detailed constitution of the developing roll is further explained. The developing roll 2 comprises a cylinder 33 made of electro-conductive aluminum, to one end of which a large diameter part 14*a* of the developing roll axis 14 is fixed, while the developing roll axis 14 is rotatably supported by a roll supporting member 15A (a rotational axis holding member) made of electro-insulating material such as synthetic resin. The end 14*b* of the developing roll 14 is connected to a bias potential source 7 (FIG. 9) with a terminal and a lead wire which are not shown in the figure.

As shown in perspective view 15A of FIG. 1, the roll supporting member 15A has two openings of 15Aa and 15Ac. The magnetic roll axis 13 of the magnetic roll 1 is rotatably fixed to one of the openings 15Aa so that the roll supporting member 15A is capable of turning around the magnetic roll axis 13. Thus, as the roll supporting member 15A has two openings 15Aa and 15Ac on the same member, the openings can be accurately formed and the developing roll 2 can swing around the magnetic roll axis 13 so that the distance between the surface of the magnetic roll and the surface of the developing roll can be maintained accurately.

The magnetic roll axis 13 preferably made of low friction material. The low friction material may be such as tungsten disulfide $WS_2$, boron nitride BN or others. Low-friction members made of such material or members on which such material is deposited by spattering or vapor deposition can be used.

The other opening 15Ac is surrounded by a round wall face 15Ad. A protrusion 15Ab is provided on the connected part of a wall 15Ag, which forms the round wall face 15Ad, and a wall 15Af which forms the opening 15Aa. A coil spring 17 is provided to the protrusion 15Ab for pressing clockwise the roll-supporting member as shown in FIG. 2.

The round wall face 15Ad has a partially cut vacancy 15Ae throughout 60 degrees of its center angle. Inside the round wall face 15Ad, there is a member for restricting the distance, in specific, gap pulley 21 (the annular member for restricting the distance between the surface of the photosensitive drum 3 (FIG. 2) and the surface of the cylinder 33 of the developing roll 2) which is rotatably fitted to the large diameter part 14*a* of the developing roll axis 14.

As shown in FIG. 2(*a*), the frame 12A of a developing case holds the rotatably the large diameter part 14*a* of the developing roll axis 14 (FIG. 1) while the frame holds the roll supporting member 15A which holds the developing roll axis 14 so as to be capable of swinging around the magnetic roll axis 13 to the direction of the arrow 52. The roll supporting member 15A is pressed by the coil spring 17 provided on the protrusion 15Ab clockwise around developing roll axis 13.

Hence, when the frame 12A is moved to the arrow 51 from the state of FIG. 2(*a*), the outer circumference of the gap pulley 21 existing at the partially cut vacancy 15Ae touches the outer circumference of the photosensitive body drum 3 and the coil spring 17 is compressed to fall the frame into the place shown in FIG. 2(*b*). In said space, the distance between the outer circumference of the drum and the developing roll, or the outer circumference of developing roll and the magnetic roll 1 is fixed in a predetermined distance.

Thus, as shown in FIG. 2, since the gap pulley 21 touches the surface of the photosensitive body drum from the right lateral side and a little below, the total weight of the frame 12A does not affect the surface of the photosensitive body drum 3 so as to enhance the endurance of the photosensitive body drum 3.

Next, actions of the magnetic roll 1 and the developing roll 2 in the developing unit 50 are explained below.

Figure 9:
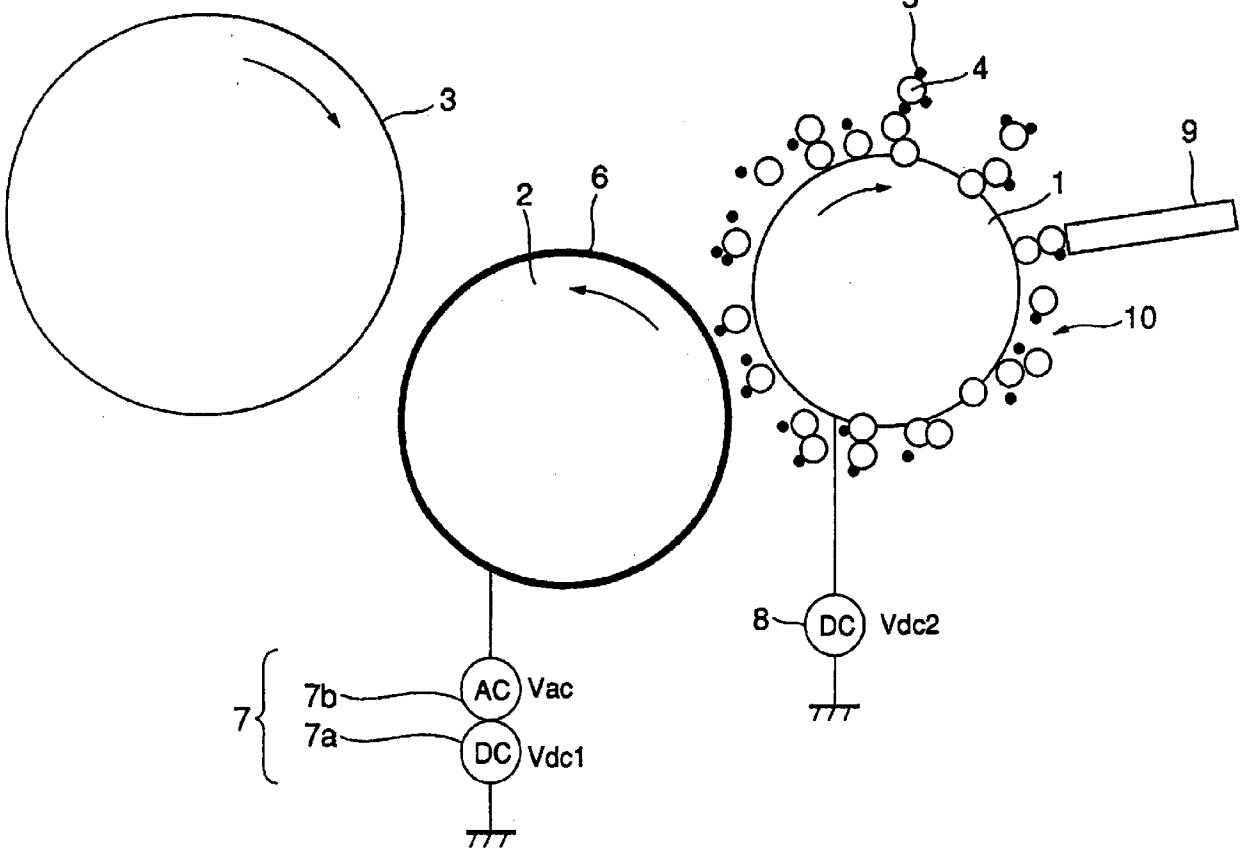
FIG. 9 is a drawing illustrating toner flowing at the time of forming an image and at the time of not forming an image.

As shown in FIGS. 7, 8 and 9, an image forming apparatus 20 has a magnetic roll 1, a developing roll 2 and a photosensitive body drum 3.

As shown in FIG. 9, the magnetic roll 1 generates a magnetic brush 10 comprising toner and carrier which holds and charges toner. A toner thin layer 6 is formed on the surface of the developing roll 2 by toner 5 supplied by the magnetic brush 10. The toner of the toner thin layer 6 is caused to jump selectively on an electrostatic latent image on the photosensitive body drum 3 to form an image.

The photosensitive body drum 3 has, on its surface, a photosensitive body having a thickness of 10–25 $\mu$m including a photosensitive layer of amorphous silicon.

Said photosensitive layer consists of a base layer around which three different layers are built, a barrier layer, a photosensitive layer of amorphous silicon and surface-protective layer respectively.

Kinds of material of the photosensitive layer are not particularly restricted so long as the material is an amorphous material containing a silicon element. An amorphous inorganic compound such as A-Si, a-SiC, a-SiO or a-SiON can be cited as for an example.

The thickness of a surface-protecting layer is 0.3–5 $\mu$m. The layer preferably consists of an amorphous silicon carbide compound having a restricted ratio of Si and C. Such compounds include preferably a-$Si_{(1-x)}Cx$ ($0.3=<x<1.0$) or more preferably a-$Si_{(1-x)}Cx$ ($0.5=<x=<0.95$). That is because the compound has so high a resistivity $10^{12}$–$10^{13}$ Ωcm that an excellent saturated electrostatic potential, abrasion resistance and humidity resistance can be obtained.

Two components developer material comprising toner 5 and carrier 4 is held on the surface of the magnetic roll 1 and toner 5 is charged at an appropriate level of 5–20 μc/g while the developer material is stirred with the stirring mixer 23 and the paddle mixer 22. The developer material is passed under the restricting blade 9 and contacts the developing roll 2 at a definite layer thickness.

The thickness of the toner thin layer 6 is determined as 10–100 μm or preferably 35–70 μm. The thickness corresponds to 5–10 layers of a toner particle provided an average diameter of the toner particle is 7 μm.

A gap between the developing roll 2 and the photosensitive body drum 3 is 150–400 μm or preferably 200–300 μm. The narrower gap less than 150 μm causes photographic fog. The broader gap greater than 400 μm causes difficulty to cause toner jump to the photosensitive body drum 3, which results in insufficient image consistency or selective development.

As developer material has a role to supply and recover toner, toner necessary for developing is supplied to the developing roll 2 by getting the magnetic brush 10 to sweep the surface of the developing roll 2 to ungluing the toner 5 attached electrostatically strongly with a nip of the carrier 4 formed between the developing roll 2 and the magnetic roll 1 using a carrier having a resistivity of $10^6$–$10^9$ Ωcm.

It is preferable to send a lot of toner 5 to the developing roll 2. With this respect, since a magnetic brush density needs to be increased in order to increase contact points with the toner 5, the magnetic brush is increased using a carrier having small diameter less than 40 μm so as to increase the surface area of the carrier 4.

According to the embodiment of the present invention, the carrier 4 having a saturated magnetism of 60–100 emu/g comprises a carrier core material having magnetism and a coated layer containing macromolecular polyethylene resin formed by polymerization on the surface of the carrier core. Further, the coated layer has a layer comprising hydrophobic silica, magnetic powder and/or fine particle resin at least as a outermost layer.

More specifically, the carrier core material has fine concavities and convexities. The coated layer comprises macromolecular polyethylene having a weight average molecular weight of 50,000 or greater which is polymerized by feeding ethylene gas to the surface of the carrier core material after getting the concavities to hold catalyst for ethylene polymerization.

Consequently, extremely high strength and durability can be available. When the carrier according to the present invention is used, even if the carrier is repeatedly used, the surface degradation of the carrier is minimal so as to be capable of forming a stable charged toner layer on the developing roll. As a result, an accurate image can be developed on the photosensitive body. Further, on account of the high durability of the carrier, the carrier need not to be changed until the end of the apparatus life.

When using a carrier having a low resistivity below $10^6$ Ωcm, which benefits recovery of toner, though it is effective for a measure for developing ghost, it is difficult for maintaining developing without photographic fog by giving accurate charge to toner, further an operation for a long time brings about a drawback of contaminating the charging device or the exposing device 57 by scattering toner from the surface of the developing roll.

A carrier having a resistivity higher than $10^9$ Ωcm can be charged but a charge potential tends to up. Using a carrier of an appropriate resistivity, it is possible to recycle the toner charged accurately to the developing roll 2 while the toner on the developing roll is recovered.

According to this embodiment of the present invention, a toner concentration in the total amount of toner and carrier of the developer material is 2–40 weight %, preferably 3–30 weight %, or more preferably 4–25 weight %.

When the toner concentration is less than 2 weight %, a charge of toner becomes high so as not to obtain enough image consistency. When the toner concentration is greater than 40 weight %, a charge of toner becomes insufficient so that toner scatters from a developing device, which results in contaminating the internal of the image forming apparatus or in generating fog of toner on an image.

A charged toner is held in thin layer with the potential difference of Δ between the magnetic roll 1 and the developing roll 2. An image is developed by applying a superimposed bias potential of alternating current and direct current between the photosensitive body drum 3 and developing roll. To prevent from scattering toner, alternating current is applied just before development.

Residual toner after development on the developing roll is easily recovered and interchanged with brush effect of the difference of a peripheral rotating rate of each roll in such a manner that the magnetic brush on the magnetic roll 1 contacts the toner layer on the developing roll 2 and by stirring developer material of the magnetic brush to interchange the developer material without providing an additional device such as a scraper blade.

As a means to enhance interchange of toner on the developing roll 2, a rotational rate of the magnetic roll 1 is 1.8 times a rotational rate of the developing roll 2 so as to recover the toner on the developing roll 2 and developer material of appropriate toner concentration is supplied to the developing roll 2 to form a uniform toner layer.

In order to maintain uniform image consistency, it is effective that a potential difference Δ between the developing roll 2 and the magnetic roll is zero at the time except for development, which results in being capable of recovering easily the toner on the developing roll 2 to the magnetic roll 1.

When a-Si photosensitive body is used as a photosensitive material, a potential on the surface after exposure becomes characteristically very low as lower than 10 V. A thinner thickness of the film brings about reducing a saturated charged potential lowering a dielectric strength of the film.

Meanwhile, an electric charge density on the surface of the photosensitive body drum 3 at the time when forming a latent image increases so as to advance in developing performance. This characteristic is apparent when a thickness of a-Si photosensitive body having a high dielectric constant of about 10 is 25 μm or lower, more preferably 20 μm or lower.

As shown in FIG. 9, an electric source 7 comprising an alternating current electric source **7*b* and a first direct current electric source 7*a* which applies a bias voltage vdc1 of 0–200 v between the photosensitive body drum 3 and the developing roll 2 is provided. Further, the alternating current electric source 7*b*** applies alternate current voltage having peek voltage of vpp=500–2000 v and a frequency of f=1–3 kHz to the photosensitive body drum (the electrostatic latent image bearing body).

And a second direct current electric source vdc2 which applies a voltage to the developing roll is provided. A voltage of the first direct current electric source **7*a* and the second direct current electric source 8 is determined so that a potential difference between the magnetic roll 1 and the developing roll 2 |vdc2−vdc1|=Δ is 100–350 v. Here, for example, vdc2 is determined as 250 v and a developing bias vdc1 as below 150 v or more preferably below 100 v. The potential difference |vdc2−vdc1**| is preferably to be 100–250 v. AC component is determined as vp-p 500–2000 v and frequency 1–3 kHz.

A layer of the magnetic brush 10 on the magnetic roll 1 is restricted by the restricting blade 9 and a thin layer 6 of toner is formed on the developing roll 2 by a potential difference |vdc2−vdc1|=Δ between the magnetic roll 1 and the developing roll 2.

Though the toner thin layer 6 on the developing roll 2 varies with a resistivity of the developer material or rotational rate difference between the developing roll 2 and the magnetic roll 1, it is also controllable with the potential difference stated above. The greater is Δ, the thicker becomes the layer of the toner on the developing roll. The smaller Δ brings about a thin layer. A range of 100 v–250 v is generally appropriate.

Here, a relationship between the bias potential Vdc1 or the potential difference |Vdc2−Vdc1| and the behavior of developing is explained from the result of experiments.

Ghost is generated when the bias potential Vdc1 is higher than 200 V. Ghost is also generated when the potential difference |Vdc2|Vdc1| is lower than 100 V.

Meanwhile, when the potential difference |Vdc2−Vdc1| is higher than 350 V, fog is generated. Therefore, a high quality image is obtained when the bias potential falls into the range of 0–200 V (except for 0) and the potential difference |Vdc2−Vdc1| falls into the range of 100–350 V.

An OPC photosensitive body has been publicly known as a photosensitive body used in an image forming apparatus. However, since an OPC photosensitive body has soft surface of photosensitive layer, a problem is the layer is apt to be scraped by friction of a cleaning blade. Since an a-Si photosensitive body has a hard surface and good durability in comparison to an OPC photosensitive body, an a-Si photosensitive body having a photosensitive layer thickness of 25 μm or greater is used recently. However, as a film of an a-Si photosensitive body is formed by a glow discharge decomposition method, the method needs much production time or production cost leading to an uneconomical result.

When a positive charging organic photoconductive body is used as a photosensitive body, it is particularly important that the thickness of a film layer of a photosensitive layer is determined as 25 μm or greater and the amount of charging material added is increased. As a charging material is added in the photosensitive layer in case of an OPC of a monolayer structure, a sensitivity varies little even if the photosensitive layer gets thinner.

Also in this case, the developing bias Vdc1 is 400 V or below or more preferably 300 V or below so as to prevent from charging strong voltage to the toner.

To charge low developing bias leads to preventing the thin film of a-Si phtosensitive body from dielectric breakdown and to preventing the toner from excess charge so as to be effective to prevent developing from histeresis phenomenon. A clear image is obtained by forming the toner layer having a thickness of 10–100 μm, preferably 35–70 μm on the developing roll 2, setting a gap between the developing roll and the photosensitive body drum for 150–400 μm, preferably 200–300 μm and causing toner jump on the photosensitive body drum through this space by means of direct and alternative current electric field.

Again referring to FIG. 9, the developer material forms the magnetic brush 10 when the toner 5 is charged at an appropriate level while stirring the developer material consisting of the carrier 4 and the toner 5 and held on the magnetic roll. The magnetic brush 10 contacts the developing roll 2 with a predetermined thickness by passing through the restricting blade 9. The gap between the restricting blade 9 and the magnetic roll 1 here is 0.3–1.5 mm. The gap between the magnetic roll 1 and the developing roll 2 is also 0.3–1.5 mm.

The gap between the developing roll 2 and the photosensitive body drum 3 is 150–400 μm, preferably 200–300 μm. When the toner thin layer is formed under the condition described above, the thickness of the toner thin layer comes to 10–70 μm, preferably 35–70 μm.

When the developing roll 2 is rotated at a linear velocity of 72 mm/s and the magnetic roll 1 is rotated 1.8 times as fast as the velocity of the developing roll, then residual developing toner can be easily interchanged with replenishing toner by brush effect of the peripheral velocity difference. This prevents ghost from generating and makes possible to form a clear image.

In this embodiment, an equipotential state of equalizing a surface potential of the developing roll 2 with the surface potential of the magnetic roll 1 is generated for a period of forming no image from the time finishing to develop a image until the time beginning to develop a next image. And under this equipotential state, the residual toner of the toner thin layer 6 on the developing roll 2 is recovered with the magnetic brush.

The period of forming no image can be detected by a printed image data or by the head end or the tail end of a sheet of recoding paper in a device for recording paper.

In this embodiment, a distance between the sheets of recording paper corresponding to the period of forming no image, i.e. a distance from the tail end of a sheet of recording paper to the head end of a next sheet of recording paper when recording paper is supplied, is 51 mm. While, as a diameter of the developing roll is 16 mm, a total peripheral length is 16π=50.27 mm. Therefore, if whole period of the period of forming no image is rendered to the equipotential state, the equipotential state can be continued for a period the developing roll 2 is rotated at least one round.

As described in FIG. 7, since a region for forming the magnetic brush $H_3$ is a width for recovering the toner on the developing roll, no unrecoverable region surely generates by getting a width of the developing roll 2 in the direction of the axis $H_1$ shorter than the region for forming the magnetic brush $H_3$.

Thus, toner does not adhere to a sleeve of the developing roll which is out of region of the magnetic brush so as to be capable of avoiding scattering toner to both ends.

When an image is formed, a toner thin layer is formed on the developing roll with a potential difference formed between the developing roll and the magnetic roll. When an image is not formed, residual toner on the developing roll is recovered with a magnetic brush on the magnetic roll having a peripheral velocity greater than that of the developing roll at the state of zero potential difference. An opportunity to contact the magnetic brush to the developing roll as well as a shear stress of the magnetic brush are increased by getting the peripheral velocity of the magnetic roll greater than that of the developing roll so as to affect the residual toner on the developing roll to weaken an adhering strength of the residual toner on to the developing roll, which results in being capable of recovering effectively the residual toner at an equipotential state without applying a potential difference between the developing roll and the magnetic roll.

Figure 3:
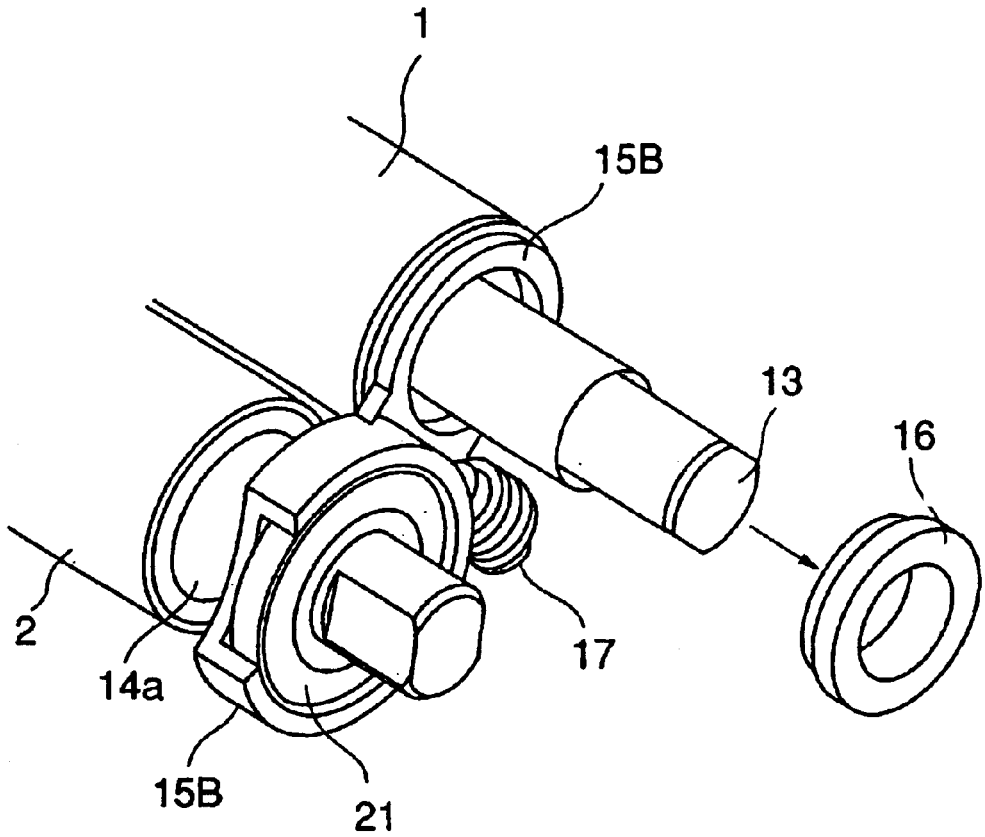
FIG. 3 is a perspective view showing another embodiment of the roll-supporting member.

Next, referring to FIG. 3, another embodiment about a bearing part of the magnetic roll 1 is explained. A difference between the first example shown in FIG. 1 and the present second example is that the bearing part comprises two components of a roll supporting body 15B and a roll supporting ring 16 in this second example while the bearing part comprises one component of the roll supporting body 15A.

The roll supporting ring 16 is preferably made of low friction material. The low friction material may be such as tungsten disulfide $WS_2$, boron nitride BN or others. Low-friction members made of such material or members on which such material is deposited by spattering or vapor deposition can be used.

According to the second example, in the bearing part of the magnetic roll 1, the roll supporting ring 16 made of low friction material is rotatably fitted to the magnetic roll axis 13, the roll supporting ring 16, outer periphery of which is fitted by the roll supporting body 15B so as to be capable of swinging. Accordingly, the bearing part has improved durability because the rotating magnetic roll axis 13 is held by the roll supporting ring 16.

As a mater of course, a bearing made of low friction material may be disposed between a surface 14*a* of developing roll axis and the roll supporting body 15B, a gap pulley 21.

Figure 4:
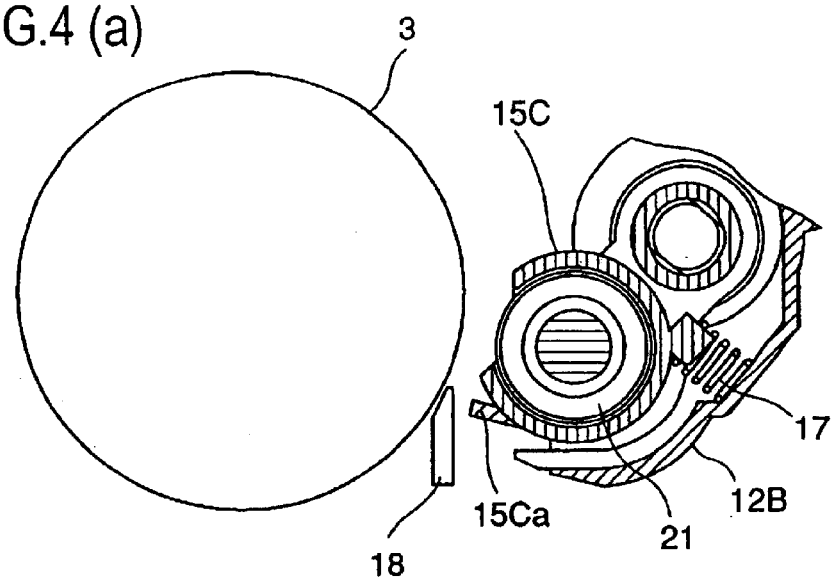
FIG. 4 is a schematic drawing illustrating a behavior of another embodiment of the roll-supporting member shown in FIG. 3.
Figure 4:
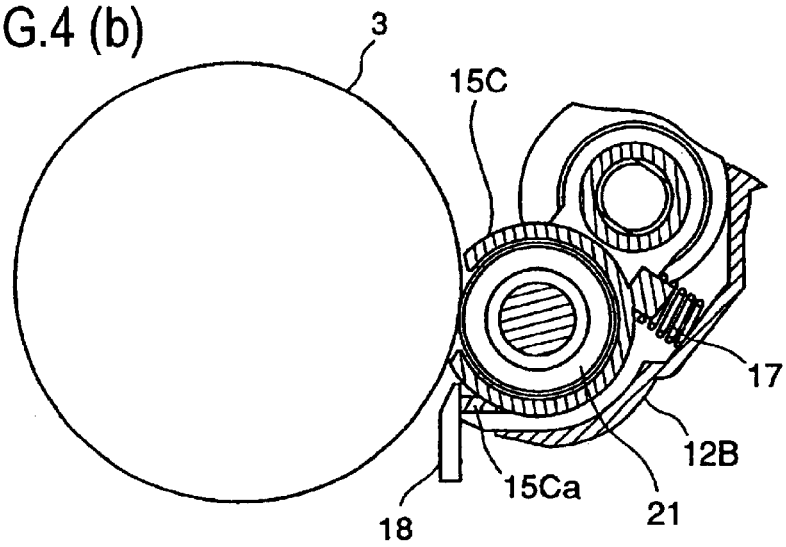

Next, referring to FIG. 4, another example providing a frame positioning means of a developing case is explained. As shown in FIG. 4*a*, a main body receiving part 18 is provided right and downward to the photosensitive body drum 3. A roll supporting body contact part 15Ca is provided on the roll supporting body 15C, the contact part being capable of contacting the main body receiving part 18. Thus, when a developing case frame 12B is moved leftward, the roll supporting body contact part 15Ca contacts the main body receiving part 18 while the gap pulley 21 contacts the surface of the photosensitive body drum 3 so that a coil spring 17 is held in the compressed state at the position shown in FIG. 4(*b*).

Therefore, the strength at this position which moves the frame 12B left ward affects the surface of the photosensitive body drum 3 through the main body receiving part 18 and the gap pulley 21 so that the strength to the photosensitive body is smaller than the case of the example shown in FIG. 2. As a result, a weight of the whole frame 12B does not affect the surface of the photosensitive body 3 through the gap pulley 21 so as to be able to improve durability of the gap pulley 21 and the photosensitive body drum 3.

According to the embodiment, as an opening for holding the developing roll on the rotating axes holding body which holds rotatably and parallel the magnetic roll and the developing roll is provided so as to be capable of swinging around the opening for holding the magnetic roll, accuracy of a pitch between the opening for holding the developing roll and the opening for holding the magnetic roll is high, the pitch can be maintained even if swinging the opening for holding the developing roll side around the opening for holding the magnetic roll side, which results in maintaining the distance between the developing roll and the magnetic roll.

As shown in FIG. 2(*a*), the frame 12A of the developing case rotatably holds the magnetic roll axis 13 and holds the developing roll to the roll supporting body 15A so as to be capable of swinging around the magnetic roll axis 13 in the direction of the arrow 52. A coil spring 17 provided at a protrusion 15Ab presses to the clockwise direction around the magnetic roll axis 13. Hence, when the frame 12A is moved to the arrow 51 from the state of FIG. 2(*a*), the outer circumference of the gap pulley 21 existing at the partially cut vacancy 5Ae touches the outer circumference of the photosensitive body drum 3 and the coil spring 17 is compressed to fall the frame into the place shown in FIG. 2(*b*). At this position, a distance between the outer circumference of the photosensitive body drum 3 and the outer circumference of the developing roll 2 and the distance between the outer circumference of the developing roll 2 and the outer circumference of the magnetic roll 1 are held for each prescribed distance.

Thus, as shown in FIG. 2(*b*), as the gap pulley 21 contacts the surface of the photosensitive body from the right lateral and a little downward position, the whole weight of the frame 12A does not affect the surface of the photosensitive body drum 3 through the gap pulley, which leads to improvement of durability of the gap pulley 21 and the photosensitive body drum 3.

Figure 6:
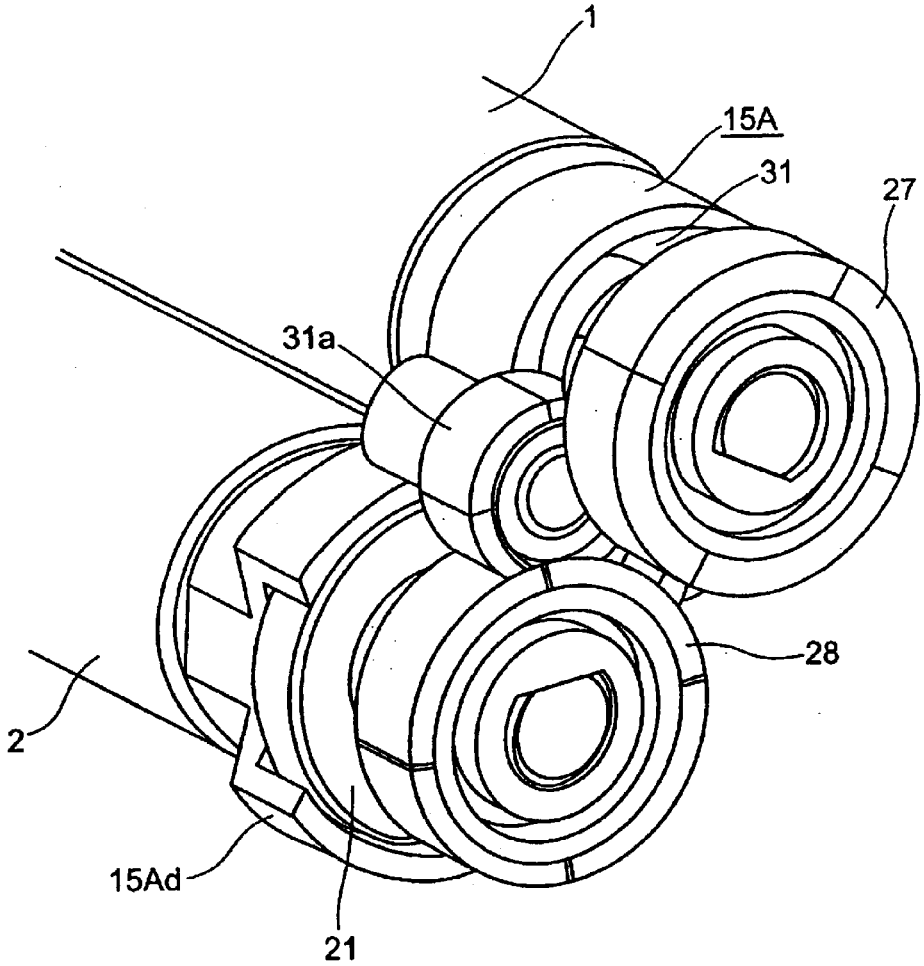
FIG. 6 is a perspective drawing illustrating a developing unit provided with an idle gear.

Therefore, in such developing unit, the developing roll 2 rotates corresponding to the rotation of the magnetic roll 1. That is, the developing roll 2 receives rotational force from the magnetic roll 1 through the transmitting gear 31 and the driving gear 28. Accordingly, an idle gear needs to be provided between the magnetic roll 1 and the developing roll 2 depending on the rotational direction of the magnetic roll 1 and the developing roll 2. That is, as shown in FIG. 6, the idle gear 31*a* needs to be provided between the transmitting gear 31 and the driving gear 28. As stated above, since the developing roll 2 swings around the magnetic roll axis 13, the pitch between the idle gear 31*a* and the transmitting gear 31 and the pitch between the idle gear 31*a* and the driving gear 28 need to be invariable.

Consequently, according to this example, the idle gear 31*a* is rotatably supported to the roll supporting body 15A. When the idle gear 31*a* is rotatably supported to the roll supporting body 15A like this case, the center distance between the transmitting gear 31 and the idle gear 31*a* is always constant, further the center distance between the driving gear 28 and the idle gear 31*a* is also constant even if the driving roll 2 swings, in other word the roll supporting body swings.

As described previously, the roll supporting body 15A swings around the magnetic roll axis and pressed by the coil spring (the tension spring) 17 toward the predetermined direction. Since the pressing direction is a direction toward the photosensitive body drum, when the developing unit is mounted at a predetermined position, the gap pulley 21 contacts the surface of the photosensitive body drum so that the gap between the developing roll and the photosensitive body drum 3 is kept for a predetermined distance.

Meanwhile, depending on the rotational direction of the developing roll 2, a force for pressing the photosensitive body drum 3 or a force for departing from the photosensitive body drum 3 is acted by the developing roll. When the force for pressing the photosensitive drum body by the developing roll affects the photosensitive body drum, the pressing force (a pressing force by driving the developing roll) may be utilized instead of the coil spring 17. For example, if the pressing force is 0.1N–0.2N, the coil spring may be omitted.

Further, if the pressing force by driving the developing roll is too strong, the abrasion of the gap pulley 21, a member for restricting the gap, becomes a problem. In this case, the force is applied to the magnetic roll in such direction as to part from the photosensitive body drum. For example, Pressing force to the photosensitive body drum 3 by the magnetic roll 1 is adjusted with a tension spring (not shown). The relationship can be expressed as, pressing force to the photosensitive body drum 3 by the magnetic roll 1=pressing force of the tension spring−parting force by driving.

That a gap is made for a predetermined distance by getting the gap pulley to contact the surface of the photosensitive body drum 3 is explained as an example. The gap may be made for a predetermined distance by getting the roll supporting body 15A itself to contact the image forming apparatus or the photosensitive body drum 3 instead.

Therefore, according to this example, since rotational axes of the magnetic roll and the developing roll are rotatably held by the member for holding rotational axes and the member for holding rotational axes swings around the axis of the magnetic roll, there is an effect on maintaining an accurate distance between the magnetic roll and the developing roll. Further, as the idle gear is rotatably supported to the member for holding rotational axes, there is another effect that not only a center distance between the magnetic roll and the idle gear can be made always constant but also a center distance between the developing roll and the idle gear can be made always constant even though the developing roll swings.

Further, according to the example, since the member for restricting a distance contacts the surface of the photosensitive body drum, a predetermined distance between the developing roll and the photosensitive body drum can be kept and since the magnetic roll is pressed to the direction of the photosensitive body drum while the developing roll and the magnetic roll are held to the member for holding rotational axes, a predetermined distance between the magnetic roll and the developing roll can also be kept.

What is claimed is:

1. An image forming apparatus comprising:

a magnetic roll and a developing roll disposed in parallel at a predetermined distance;

a developing unit for developing an electrostatic latent image on a photosensitive body drum disposed on a main body of said image forming apparatus using a toner thin layer formed on the surface of said developing roll by means of said magnetic roll;

a supporting member having a pair of openings for rotatably holding a rotational axis of said magnetic roll and a rotational axis of said developing roll wherein said opening for holding said rotational axis of said developing roll is capable of pivoting about an axis center of said opening for holding said rotational axis of said magnetic roll; and a protrusion and a spring located between said developing roll and said magnetic roll axes for pivoting said opening of said supporting member for holding said rotational axis of said developing roll about said axis center of said opening for holding said rotational axis of said magnetic roll.

2. An image forming apparatus according to claim 1 wherein at least one of said magnetic roll and said developing roll further comprise a fitting part made of a low friction material.

3. The image forming apparatus according to claim 1 further comprising:

a gear for said magnetic roll;

an idle gear;

a gear for said developing roll, wherein said gear for said developing roll receives a driving force from said gear for the magnetic roll through said idle gear; and said supporting member which pivots about said axis center of said opening for holding said rotational axis of said magnetic roll and rotatably holds each of said rotational axes of said magnetic roll, said developing roll and said idle gear.

* * * * *